US006247467B1

(12) United States Patent
Siegfried

(10) Patent No.: US 6,247,467 B1
(45) Date of Patent: Jun. 19, 2001

(54) BOWSTRING RELEASE MECHANISM

(76) Inventor: Ralph Siegfried, 15145 Strong Rd., Dallas, OR (US) 97338

( * ) Notice: Subject to any disclaimer, the term of this patent is extended or adjusted under 35 U.S.C. 154(b) by 0 days.

(21) Appl. No.: 09/568,773

(22) Filed: May 10, 2000

(51) Int. Cl.[7] ..... F41B 5/18
(52) U.S. Cl. ..... 124/35.2
(58) Field of Search ..... 124/33, 35.2

(56) References Cited

U.S. PATENT DOCUMENTS 1,179,301 * 4/1916 Hammond ..... 124/33 X
5,505,187 * 4/1996 Troncoso et al. ..... 124/35.2
5,575,269 * 11/1996 Harklau ..... 124/35.2

OTHER PUBLICATIONS

Advertisement for "Cantpunch" bowstring release, Archery Magazine, Nov. 1978, p. 24.*

* cited by examiner

*Primary Examiner*—John A. Ricci
(74) *Attorney, Agent, or Firm*—Chernoff, Vilhauer, Mc Clung, & Stenzel

(57) ABSTRACT

A release system for use with a projectile firing device includes a trigger for initiating a time period. The device includes a timer with fluid that is operable with the trigger for establishing, at least in part, a time period. The device also includes a release mechanism operable with the timer for propelling the projectile based upon the time period.

34 Claims, 3 Drawing Sheets

BOWSTRING RELEASE MECHANISM

BACKGROUND OF THE INVENTION

The present invention relates to an archery device for assisting in producing accurate shots. In particular, the present invention relates to a bowstring release mechanism with a delayed release.

Many archers in both hunting and target shooting experience inaccurate shots due to flinching or movement at the critical time of releasing the bowstring to launch an arrow. Flinching or movement may be caused by anticipation of a shot, physical breakdown, or mental deterioration.

Anticipation of the shot, or target anxiety, often causes tension and excessive movement of the bow due to the expectation of the coming explosion and recoil of the shot. After drawing the bowstring and arrow, the archer takes aim. Physical breakdown of the shot normally occurs when the archer has aimed too long. The maximum ideal holding period is 5–7 seconds. Thus, when an archer is at full draw for too long, his or her muscles begin to weaken and shooting form breaks down causing an inaccurate shot. Finally, mental deterioration occurs due to the mind's inability to concentrate on more than one thing at a time. During execution of a shot, the archer should be focused exclusively on aiming. Focusing on other events such as gently releasing the bowstring or a trigger, utilizing a proper breathing technique and exercising self control to drawn down if all the requisite conditions to a good shot are not met, may inhibit the archer from maintaining a proper site picture and thus result in an inaccurate shot.

The use of conventional mechanical or electrical release mechanisms do not address or alleviate these concerns. The archer must still perform the aforementioned requisite conditions along with aiming during the critical time of shot release thereby increasing the likelihood of flinching or movement during that time.

U.S. Pat. No. 5,243,957, incorporated by reference herein, illustrates these limitations with a release mechanism for use with a two handed bow activated by a trigger switch on one of the hand grips. At the critical time of releasing the bowstring, an archer still must be concerned with gently activating the trigger, utilizing a proper breathing technique, exercising self-control to draw down the bow if the requisite conditions are not met, and maintaining a proper site picture or focus on the target. Attempting to achieve all these conditions at the critical time increases the likelihood of mental deterioration and physical breakdown. Furthermore, because the archer knows the bowstring will release immediately upon activation of the switch, anticipation of the shot and the associated movement or flinching will only compound the difficulty of achieving an accurate shot, all generally referred to as "target panic".

Harklau, U.S. Pat. No. 5,575,269, discloses a bowstring release apparatus with a bowstring affixed to a bow. The bowstring release mechanism is comprised of an activation switch, a timing device, and a release mechanism. The activation switch is connected to the timing device which in turn is connected to the release mechanism. The bowstring release apparatus is activated by the activation switch which initiates the start of a timing period. The timing device, connected to the activation switch, establishes a length of time representing the time period. The release mechanism, connected to the timing device, releases the secured bowstring after expiration of the time period. Unfortunately, the electronic based device taught by Harklau is expensive, complicated, and difficult to repair while hunting away from town. Accordingly, if the electronics malfunction, there is little likelihood that the archer will be able to repair the device. Moreover, if the device of Harklau becomes wet, such as being used while hunting, or the battery runs low, then the device will not function at all.

What is desired, therefore, is a bowstring release apparatus that relieves "target panic", is relatively easy to repair while hunting, and is inexpensive.

SUMMARY OF THE INVENTION

The present invention overcomes the aforementioned drawbacks of the prior art by providing a release system for use with a projectile firing device that includes a trigger for initiating a time period. The device includes a timer with fluid that is operable with the trigger for establishing, at least in part, a time period. The device also includes a release mechanism operable with the timer for propelling the projectile based upon the time period.

The foregoing and other objectives, features and advantages of the invention will be more readily understood upon consideration of the following detailed description of the invention, taken in conjunction with the accompanying drawings.

DETAILED DESCRIPTION OF THE PREFERRED EMBODIMENT

Figure 1:
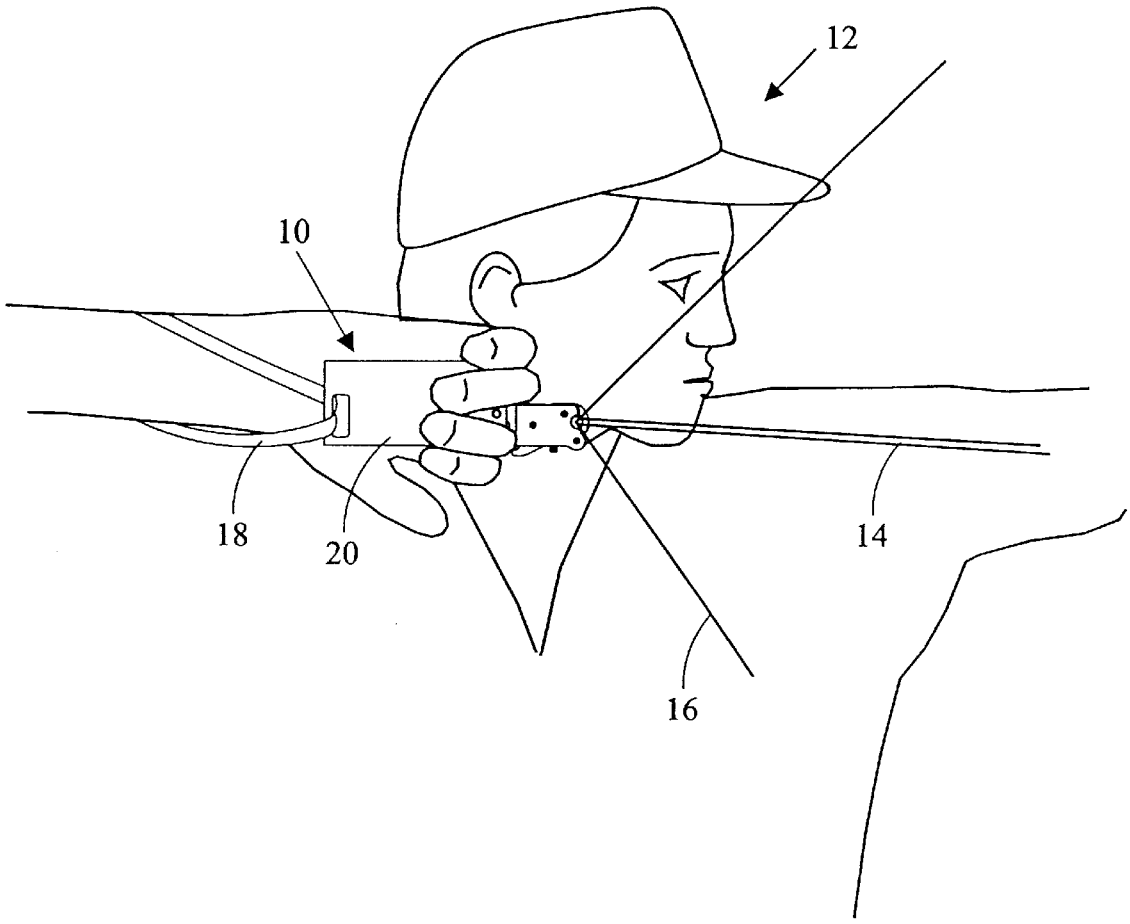
FIG. 1 is a perspective view of a drawn bow incorporating the bowstring release mechanism of the present invention.
Figure 2:
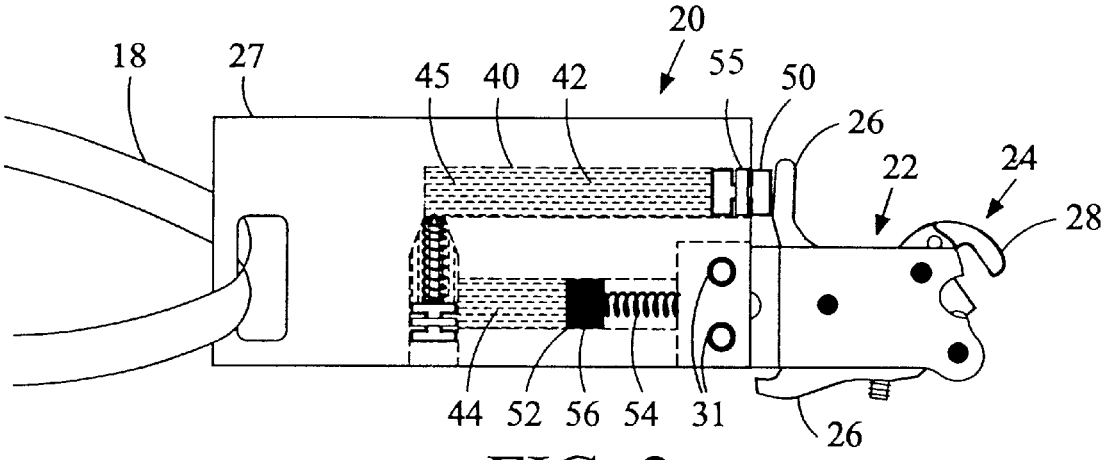
FIG. 2 is a exemplary embodiment of an archery release apparatus including a fluid based timer in the opened position and a flow resister.
Figure 3:
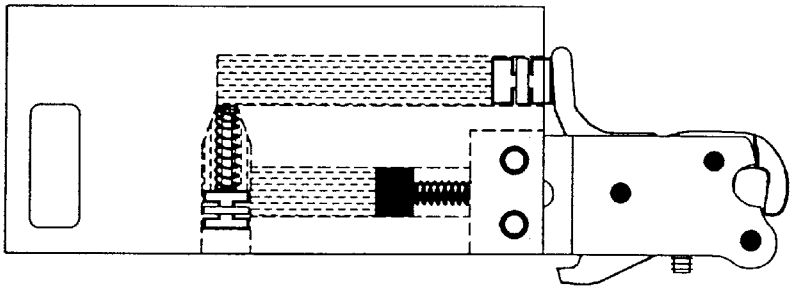
FIG. 3 is the archery release apparatus of FIG. 2 in the closed position.

Referring to FIG. 1, a preferred embodiment of the present invention includes a bowstring release mechanism 10 used by an archer 12 to shoot an arrow 14 by releasably securing a bowstring 16. The bowstring release mechanism 10 may include a retainer wrist loop 18 and a case 20. Alternatively, the retainer loop 18 (if included) may be any type of retention device or structure that assists the archer in holding the case 20 while being tensioned by the bowstring 16. Referring to FIG. 2, the case 20 may include a head 22 with a release mechanism 24. A trigger 26 is pushed or otherwise biased forward toward the front of the head 22 thereby releasing the jaw 28 and permitting it to be opened. After locating the bowstring 16 within the jaw 28, the trigger 26 is pulled or otherwise biased backward away from the front of the head 22. With the trigger 26 moved backward, the jaw 28 may be locked in a closed position with the bowstring 16 retained therein. The head 22 maybe modular and attached to a body 27 by a securement mechanism, such as a pair of bolts 31. The body 27 defines a cavity 40 therein, generally having a piston supply conduit 42 and a fluid reservoir 44 filled with a fluid 45, such as hydraulic fluid. The trigger 26 is pulled against a first piston 50 which in turn forces fluid 45 within the cavity 40 to press against a second piston 52. As the second piston 52 moves, as a result of pulling on the trigger 26, a spring 54 is compressed or otherwise tensioned, as shown in FIG. 3. The first and second pistons 50, 52 may include a respective gasket 55, 56 to prevent the passage of the fluid 45. After the archer releases the trigger 26, the spring 54 pushes the second piston 52, which in turn forces fluid 45 within the cavity 40 to press against the first piston 50, which in turn presses against the trigger 26. As the trigger 26 is pressed outward, the jaw 28 opens under tension thereby releasing the bowstring 16 retained therein.

Figure 4:
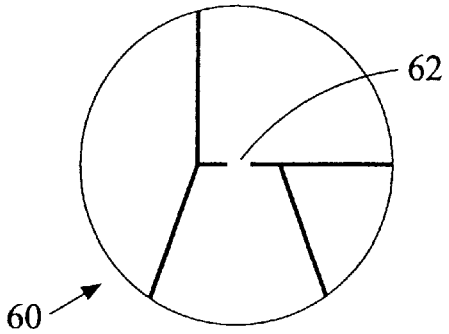
FIG. 4 is a partial view of a flow resister for the release apparatus of FIG. 2.
Figure 5:
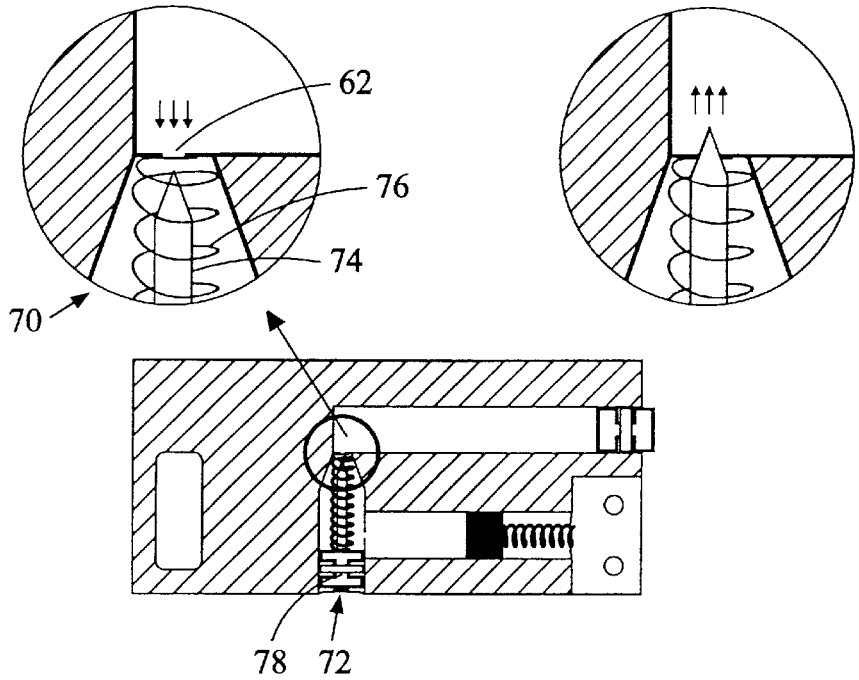
FIG. 5 is a partial view of a variable flow resister for the release apparatus of FIG. 2, shown at two different positions.

To control the rate of the fluid flow and provide a delayed release after releasing the trigger 26, a flow resistor 60 may be included, as shown in FIG. 4. The flow resistor 60 includes an orifice 62 that inhibits the free flow of the fluid 45 from the reservoir 44 into the piston supply conduit 42 (and vice versa). While the use of a flow resistor 60 is acceptable, many archers may desire to vary or otherwise select the delay incurred. One technique to vary the delay is to select a fluid 45 with the appropriate characteristics, such as viscosity. Referring to FIG. 5, the preferred technique to vary the delay is to include a variable flow resister 70. The variable flow resister 70 may include a metering valve 72 comprised of a nut 78 or other device that may be adjusted in depth, a needle 74 affixed to the nut 78, and a spring 76 surrounding the needle 74. By varying the proximity of the needle with respect to the orifice 62, the archer may readily adjust the delay, as shown in the two expanded views of FIG. 5. This variance in the proximity may be achieved, for example, by screwing the nut 78 within a threaded cavity.

The archer 12 utilizes the bowstring release mechanism 10 by securing it to the bowstring 16. The archer 12 then draws the bowstring 16 and obtains a proper sight picture. Upon achieving a proper sight picture, the archer 12 releases the trigger 26 which initiates a firing sequence. It is to be understood that the "trigger" as used herein, relates to any mechanism, such as an action by the archer or simply the lack of an action, that thereafter results in the releasing of the arrow 14. A delay, or variable time delay mechanism is incorporated into the firing sequence and occurs after releasing the trigger 26. The delay, or variable time delay, allows the archer 12, after releasing the trigger 26, to reacquire the proper sight picture and focus exclusively on aiming. Upon expiration of the time delay, the bowstring release mechanism 10 causes the jaw 28 to release the bowstring 16 and launch the arrow 14.

The preferred embodiment improves the shot of the archer 12 by incorporating a time delay into the firing sequence to prevent archer flinching or movement. Shot anticipation is eliminated, or otherwise reduced, due to the shot occurring at a time after releasing the trigger 26. It is to be understood that the time delay may likewise be triggered based on any other "releasing action" of the bowstring release mechanism 10, which is dependant on the particular type of bowstring release mechanism 10 used. Mental deterioration does not occur once the trigger 26 is released, no other actions are required, and thus the archer 12 may focus exclusively on aiming. Also, physical deterioration is prevented by establishing a range of potential times to ensure that the shot occurs prior to physical breakdown.

If desired, the bowstring release may include an indicator, preferably on the side thereof, indicating the time duration of the delay. Adjustment of the delay, such as by changing the relative proximity of the needle valve to the orifice, likewise results in a change in the indicator.

Figure 6:
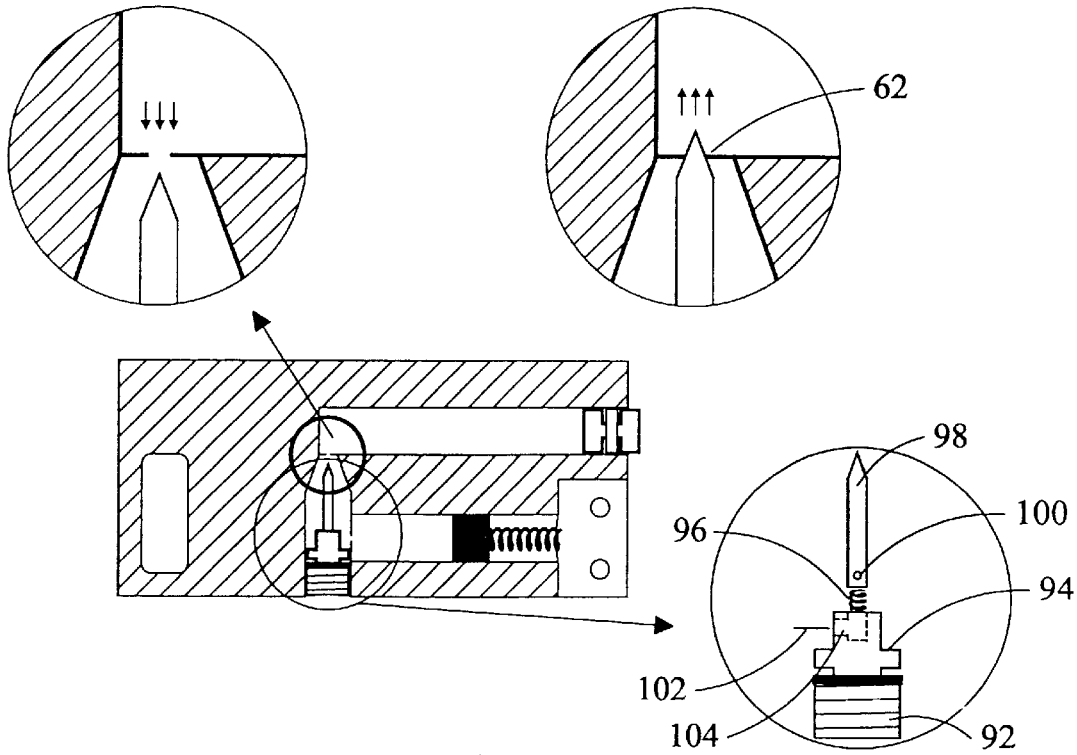
FIG. 6 partial view of an alternative variable flow resister for the release apparatus of FIG. 2, shown at two different positions.

After further consideration, the present inventor came to the realization that the flow resistor, and variable flow resistor, results in substantial resistance to the pulling of the trigger 26. The archer 12 may tend to get tired having to pull hard on the trigger 26 to move the fluid from the piston supply conduit into the reservoir. Referring to FIG. 6, an alternative embodiment includes spring based variable valve resister 90. The variable valve resister 90 includes a nut 92, a support 94 defining a hole therein, a spring 96 sized to fit within the hole, and a needle 98 including a hole 100 therethrough. The needle 98 is secured with a pin 102 through an elongate vertical slot 104. As the trigger 26 is pulled, the fluid is pressed against the metering valve and accordingly compressing the spring and lowering the needle 98. This moves the metering valve away from the orifice 62 resulting in less resistance to the movement of fluid from the piston supply conduit to the reservoir. After the trigger 26 is fully retracted, or otherwise maintained in a relatively constant position, the metering valve will have a tendency to move the needle 98 forward under pressure of the spring 98 until the pin 102 reaches the top of the elongate vertical slot 104. In addition, upon releasing the trigger 26 the metering valve will likewise move forward, if not already moved forward in the same manner, thereby inhibiting the flow of fluid through the orifice 62 to a greater extent than during pulling of the trigger 26. This dual resistance fluid system reduces the stress on the archer to move additional fluid into the reservoir while simultaneously permitting effective control over the delay. In addition, the delay may be readily changed modifying the height of the nut 92. It is to be understood that the fluid based timer may operate in conjunction with any other suitable mechanism to result in the release of the arrow. In addition, it is to be understood that a variable flow resister may change resistance based on other fluid or mechanical techniques.

All the references cited herein are incorporated by reference.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A release apparatus for use with a projectile firing device comprising (a) a trigger for initiating a time period;

(b) a timer including fluid operable with said trigger for establishing, at least in part, a time period; and (c) a release mechanism operable with said timer for propelling the projectile based upon said time period, wherein said release apparatus defines a cavity therein holding the fluid, and said cavity includes an orifice through which fluid passes during said time period.

2. A release apparatus for use with a projectile firing device comprising (a) a trigger for initiating a time period;

(b) a timer including fluid operable with said trigger for establishing, at least in part, a time period; and (c) a release mechanism operable with said timer for propelling the projectile based upon said time period, wherein said release apparatus defines a cavity therein holding the fluid, wherein said trigger is operatively connected to a first piston at least partially within said cavity.

3. The apparatus of claim 2 wherein said first piston is operatively connected to said fluid.

4. The apparatus of claim 3 further comprising a second piston at least partially within said cavity.

5. The apparatus of claim 4 wherein said second piston is operatively connected to said fluid wherein movement of said trigger results in movement of said second piston.

6. The apparatus of claim 5 wherein said second piston is resiliently biased.

7. The apparatus of claim 6 wherein said biasing is using a spring.

8. The apparatus of claim 7 wherein said cavity includes an orifice through which fluid passes during said time period.

9. The apparatus of claim 8 further comprising a variable flow resister for said fluid.

10. The apparatus of claim 9 wherein said variable flow resister is operable with said orifice.

11. The apparatus of claim 10 wherein:

(a) said variable flow resister having a first resistance when said fluid flows in a first direction; and (b) said variable flow resister having a second resistance when said fluid flows in a second direction, wherein said first resistance is less than said second resistance.

12. The apparatus of claim 11 wherein said first direction is fluid flow as a result of pulling said trigger.

13. The apparatus of claim 12 wherein said second direction is fluid flow as a result of releasing said trigger.

14. The apparatus of claim 13 wherein said variable flow resister is adjustable with a screw.

15. A bowstring release apparatus for use with a bowstring affixed to a bow, the bowstring release apparatus comprising:

(a) a release mechanism for securing the bowstring until releasing based upon a time period;

(b) a trigger for initiating said time period; and (c) a timer including fluid for establishing, at least in part, a length of said time period, wherein said cavity includes an orifice through which fluid passes during said time period.

16. A bowstring release apparatus for use with a bowstring affixed to a bow, the bowstring release apparatus comprising:

(a) a release mechanism for securing the bowstring until releasing based upon a time period;

(b) a trigger for initiating said time period; and (c) a timer including fluid for establishing, at least in part, a length of said time period, wherein said trigger is operatively connected to a first piston at least partially within said cavity.

17. The apparatus of claim 16 wherein said first piston is operatively connected to said fluid.

18. The apparatus of claim 17 further comprising a second piston at least partially within said cavity.

19. The apparatus of claim 18 wherein said second piston is operatively connected to said fluid wherein movement of said trigger results in movement of said second piston.

20. The apparatus of claim 19 wherein said second piston is resiliently biased.

21. The apparatus of claim 20 wherein said cavity includes an orifice through which fluid passes during said time period.

22. A bowstring release apparatus for use with a bowstring affixed to a bow, the bowstring release apparatus comprising:

(a) a release mechanism for securing the bowstring until releasing based upon a time period;

(b) a trigger for initiating said time period;

(c) a timer including fluid for establishing, at least in part, a length of said time period; and (d) a variable flow resister for said fluid.

23. The apparatus of claim 22 wherein said variable flow resister is operable with an orifice.

24. The apparatus of claim 23 wherein:

(a) said variable flow resister having a first resistance when said fluid flows in a first direction; and (b) said variable flow resister having a second resistance when said fluid flows in a second direction, wherein said first resistance is less than said second resistance.

25. A method for improving shooting accuracy of an archer using a bow, a bowstring affixed to the bow, an arrow and a bowstring release apparatus, the method comprising:

(a) drawing a bowstring;

(b) activating a trigger;

(c) releasing the bowstring after completion of a time period, wherein duration of the time period is, at least in part, based upon a fluid which is responsive to said trigger; and (d) said fluid is retained within a cavity defined by said release apparatus and said fluid passes through an orifice during said time period.

26. A method for improving shooting accuracy of an archer using a bow, a bowstring affixed to the bow, an arrow and a bowstring release apparatus, the method comprising:

(a) drawing a bowstring;

(b) activating a trigger;

(c) releasing the bowstring after completion of a time period, wherein duration of the time period is, at least in part, based upon a fluid which is responsive to said trigger, and (d) said fluid is retained within a cavity defined by said release apparatus, wherein said trigger is operatively connected to a first piston at least partially within said cavity and is operatively connected to said fluid, a second piston at least partially within said cavity and is operatively connected to said fluid wherein movement of said trigger results in movement of said second piston.

27. The method of claim 26 wherein said second piston is resiliently biased.

28. A method for improving shooting accuracy of an archer using a bow, a bowstring affixed to the bow, an arrow and a bowstring release apparatus, the method comprising:

(a) drawing a bowstring;

(b) activating a trigger; and (c) releasing the bowstring after completion of a time period, wherein duration of the time period is, at least in part, based upon a fluid which is responsive to said trigger, wherein said time period is based upon, at least in part, a variable flow resister.

29. The method of claim 28 wherein:

(a) said variable flow resister having a first resistance when said fluid flows in a first direction; and (b) said variable flow resister having a second resistance when said fluid flows in a second direction, wherein said first resistance is less than said second resistance.

30. A method for improving shooting accuracy of an archer by providing a bow, a bowstring affixed to the bow, an arrow and a bowstring release apparatus, the method comprising:

(a) securing the bowstring into the bowstring release apparatus;

(b) drawing the bowstring using the bowstring release apparatus;

(c) activating a trigger connected to the bowstring release apparatus; and (d) releasing the bowstring from the bowstring release apparatus after a time period following activation of said trigger, wherein duration of the time period is determined, at least in part, by a fluid based device, wherein said fluid is retained within a cavity defined by said release apparatus and wherein fluid passes through an orifice during said time period.

31. A method for improving shooting accuracy of an archer by providing a bow, a bowstring affixed to the bow, an arrow and a bowstring release apparatus, the method comprising:

(a) securing the bowstring into the bowstring release apparatus;

(b) drawing the bowstring using the bowstring release apparatus;

(c) activating a trigger connected to the bowstring release apparatus; and (d) releasing the bowstring from the bowstring release apparatus after a time period following activation of said trigger, wherein duration of the time period is determined, at least in part, by a fluid based device, wherein said fluid is retained within a cavity defined by said release apparatus, and wherein said trigger is operatively connected to a first piston at least partially within said cavity and is operatively connected to said fluid, a second piston at least partially within said cavity and is operatively connected to said fluid wherein movement of said trigger results in movement of said second piston.

32. The method of claim 31 wherein said second piston is resiliently biased.

33. A method for improving shooting accuracy of an archer by providing a bow, a bowstring affixed to the bow, an arrow and a bowstring release apparatus, the method comprising:

(a) securing the bowstring into the bowstring release apparatus;

(b) drawing the bowstring using the bowstring release apparatus;

(c) activating a trigger connected to the bowstring release apparatus; and (d) releasing the bowstring from the bowstring release apparatus after a time period following activation of said trigger, wherein duration of the time period is determined, at least in part, by a fluid based device, wherein said time period is based upon, at least in part, a variable flow resister.

34. The method of claim 33 wherein:

(a) said variable flow resister having a first resistance when said fluid flows in a first direction; and (b) said variable flow resister having a second resistance when said fluid flows in a second direction, wherein said first resistance is less than said second resistance.

* * * * *

UNITED STATES PATENT AND TRADEMARK OFFICE

CERTIFICATE OF CORRECTION

PATENT NO. : 6,247,467 B1
DATED : June 19, 2001
INVENTOR(S) : Raplh Siegfried

It is certified that error appears in the above-identified patent and that said Letters Patent is hereby corrected as shown below:

Column 1,
Line 28, change "drawn" to -- draw --

Column 4,
Line 41, change "comprising" to -- comprising: --
Line 51, change "comprising" to -- comprising: --

Column 6,
Line 28, change "trigger," to -- trigger: --

Signed and Sealed this

Twenty-third Day of April, 2002

*Attest:*

*Attesting Officer*

JAMES E. ROGAN
*Director of the United States Patent and Trademark Office*